US011112743B2

(12) United States Patent
Takahashi et al.

(10) Patent No.: US 11,112,743 B2
(45) Date of Patent: Sep. 7, 2021

(54) RECORDING MATERIAL PROCESSING APPARATUS INCLUDING ALIGNMENT UNIT FOR ALIGNING RECORDING MATERIALS AND IMAGE FORMING APPARATUS

(71) Applicant: CANON KABUSHIKI KAISHA, Tokyo (JP)

(72) Inventors: Genki Takahashi, Mishima (JP); Kazuhisa Sato, Suntou-gun (JP); Seiji Yokoyama, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 76 days.

(21) Appl. No.: 16/504,515

(22) Filed: Jul. 8, 2019

(65) Prior Publication Data

US 2019/0332050 A1 Oct. 31, 2019

Related U.S. Application Data

(63) Continuation of application No. 15/903,715, filed on Feb. 23, 2018, now Pat. No. 10,386,772, which is a (Continued)

(30) Foreign Application Priority Data

Dec. 24, 2014 (JP) ..... 2014-261248

(51) Int. Cl.
*B65H 31/30* (2006.01)
*G03G 15/00* (2006.01)
(Continued)

(52) U.S. Cl.
CPC ..... *G03G 15/6538* (2013.01); *B65H 31/02* (2013.01); *B65H 31/24* (2013.01);
(Continued)

(58) Field of Classification Search
CPC ..... B65H 31/02; B65H 31/3018; B65H 2301/4213; B65H 43/06
See application file for complete search history.

(56) References Cited

U.S. PATENT DOCUMENTS 6,421,523 B1 * 7/2002 Kondo ..... G03G 15/6547 270/58.3
6,942,206 B2 9/2005 Kuwata et al.
(Continued)

FOREIGN PATENT DOCUMENTS

JP 2000-143082 A 5/2000
JP 2003-073011 A 3/2003
(Continued)

OTHER PUBLICATIONS

Office Action dated Nov. 2, 2019, in Japanese Patent Application No. 2014-261248.

*Primary Examiner* — Howard J Sanders
(74) *Attorney, Agent, or Firm* — Venable LLP

(57) ABSTRACT

A recording material processing apparatus includes: a first stacking unit configured to stack a recording material; a second stacking unit provided on a downstream side of the first stacking unit in a conveyance direction of the recording material; an alignment unit configured to align the recording material stacked in the first stacking unit before the recording material is discharged to the second stacking unit; and a control unit configured to perform control of discharging the recording material to the second stacking unit by switching between first control not to align the recording material by the alignment unit and second control to align the recording material by the alignment unit.

4 Claims, 14 Drawing Sheets

Related U.S. Application Data continuation of application No. 14/967,681, filed on Dec. 14, 2015, now Pat. No. 9,933,743.

(51) Int. Cl.

| | |
|---|---|
| ***B65H 31/02*** | (2006.01) |
| ***B65H 31/24*** | (2006.01) |
| ***B65H 31/36*** | (2006.01) |
| ***B65H 31/38*** | (2006.01) |
| ***B65H 43/06*** | (2006.01) |

(52) U.S. Cl.

CPC ..... *B65H 31/3018* (2013.01); *B65H 31/36* (2013.01); *B65H 31/38* (2013.01); *B65H 43/06* (2013.01); *B65H 2301/4212* (2013.01); *B65H 2301/4213* (2013.01); *B65H 2405/332* (2013.01); *B65H 2801/06* (2013.01)

(56) References Cited

U.S. PATENT DOCUMENTS

| | | | |
|---|---|---|---|
| 7,055,815 | B2 | 6/2006 | Sato et al. |
| 7,134,659 | B2 | 11/2006 | Sato et al. |
| 7,431,291 | B2 | 10/2008 | Sato et al. |
| 8,770,571 | B2 | 7/2014 | Ando et al. |
| 8,864,129 | B2 | 10/2014 | Fukuda |
| 9,446,921 | B2 | 9/2016 | Habara |
| 2003/0193133 | A1 | 10/2003 | Sato et al. |
| 2014/0131940 | A1 | 5/2014 | Fukuda |

FOREIGN PATENT DOCUMENTS

| | | | |
|---|---|---|---|
| JP | 2003-300656 | A | 10/2003 |
| JP | 2013-035629 | A | 2/2013 |
| JP | 2013-230891 | A | 11/2013 |
| JP | 2014-094815 | A | 5/2014 |
| JP | 2014-109957 | A | 6/2014 |

* cited by examiner

RECORDING MATERIAL PROCESSING APPARATUS INCLUDING ALIGNMENT UNIT FOR ALIGNING RECORDING MATERIALS AND IMAGE FORMING APPARATUS

This is a continuation of U.S. patent application Ser. No. 15/903,715, filed Feb. 23, 2018, which is a continuation of U.S. patent application Ser. No. 14/967,681, filed Dec. 14, 2015 and issuing as U.S. Pat. No. 9,933,743.

BACKGROUND OF THE INVENTION

Field of the Invention

The present invention relates to a recording material processing apparatus that performs offset processing on recording materials and an image forming apparatus provided with the recording material processing apparatus.

Description of the Related Art

Among image forming apparatuses, there is an image forming apparatus which has a recording material processing apparatus capable of performing offset processing on a recording material and discharging the recording material. Such a recording material processing apparatus receives and stacks a recording material on which an image has been formed, bundles one or more stacked recording materials into a single bundle using an alignment member, and discharges the bundled recording materials by shifting each bundle. Japanese Patent Laid-Open No. 2013-230891 discloses an arrangement in which offset processing is performed by two alignment members having different driving sources. Japanese Patent Laid-Open No. 2000-143082 also discloses an arrangement in which offset processing is performed by shifting a bundle after aligning the recording materials by an alignment member.

The cost of the arrangement of the Japanese Patent Laid-Open No. 2013-230891 increases since a driving source is provided in each of the two alignment members. The throughput decreases in an arrangement in which the bundle is shifted after aligning the recording materials by the alignment members since it becomes necessary to create an interval between the recording materials for each bundle shift operation. Although Japanese Patent Laid-Open No. 2000-143082 discloses a buffer roller provided to prevent this decrease in throughput, the cost increases due to the provision of the buffer roller.

SUMMARY OF THE INVENTION

According to an aspect of the present invention, a recording material processing apparatus includes: a first stacking unit configured to stack a recording material; a second stacking unit provided on a downstream side of the first stacking unit in a conveyance direction of the recording material; an alignment unit configured to align the recording material stacked in the first stacking unit before the recording material is discharged to the second stacking unit; and a control unit configured to perform control of discharging the recording material to the second stacking unit by switching between first control not to align the recording material by the alignment unit and second control to align the recording material by the alignment unit.

Further features of the present invention will become apparent from the following description of exemplary embodiments with reference to the attached drawings.

DESCRIPTION OF THE EMBODIMENTS

Exemplary embodiments of the present invention will be described below with reference to the accompanying drawings. Note that the exemplary embodiments below are merely examples and the present invention is not limited to the contents of the embodiments. Furthermore, components which are not necessary for a description of the embodiments will be omitted from the accompanying drawings.

First Embodiment

Figure 1:
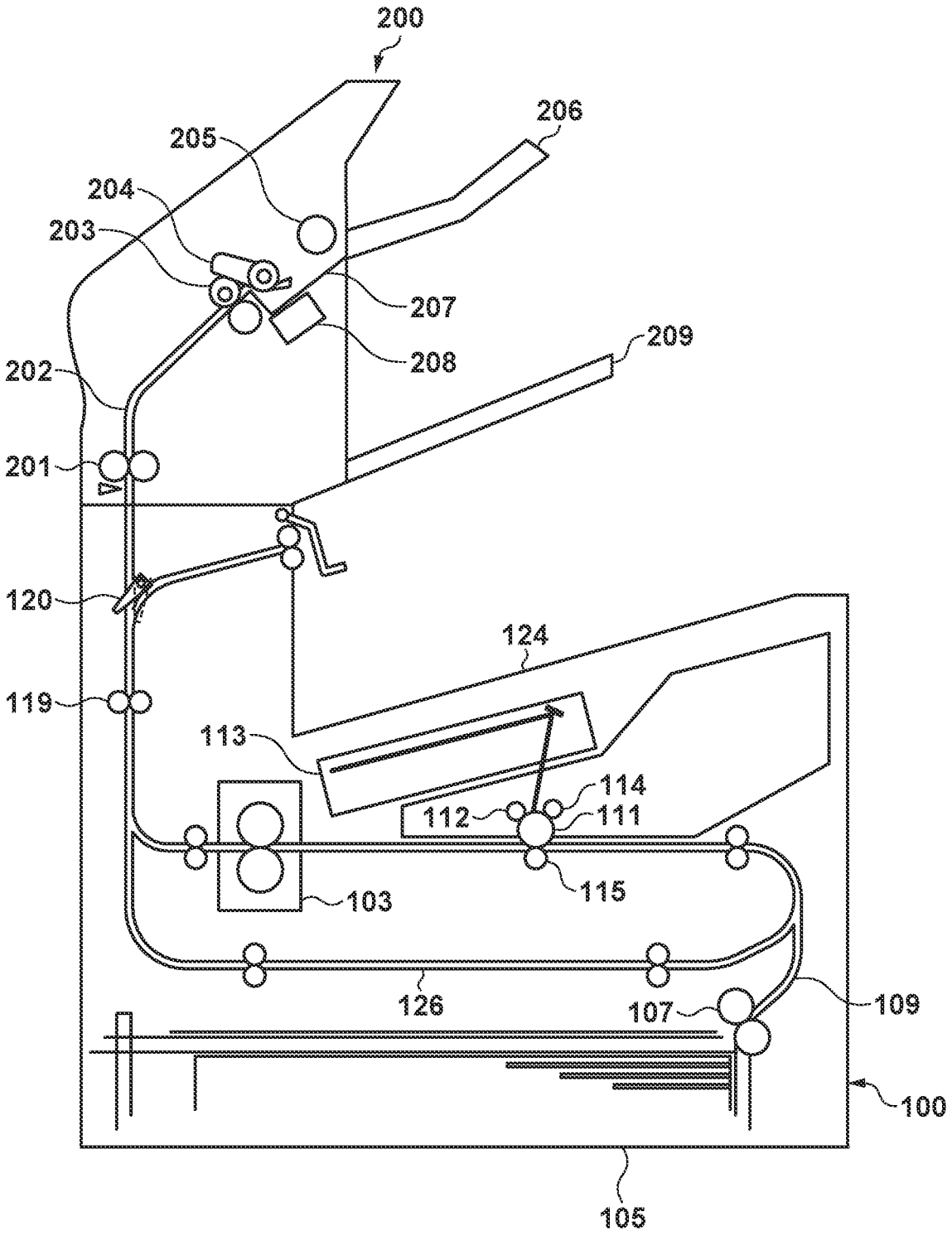
FIG. 1 is a view showing the arrangement of an image forming apparatus according to an embodiment.

FIG. 1 is a view showing the arrangement of an image forming apparatus 100 which includes a recording material processing apparatus 200. When forming an image, a photosensitive member 111 is rotated clockwise in FIG. 1. A charging roller 112 charges the surface of the photosensitive member 111 to have a uniform potential. An exposure unit 113 scans and exposes the photosensitive member 111 with light to form an electrostatic latent image. A developing unit 114 outputs a developing bias to develop the electrostatic latent image of the photosensitive member 111 by toner and visualizes the image as a toner image. Rollers 107 feed each recording material stored in a cassette 105 onto a conveyance path 109. The recording material is conveyed toward the nip region of the photosensitive member 111 and a transfer roller 115 by rollers provided along the conveyance path. The transfer roller 115 outputs a transfer bias to transfer the toner image of the photosensitive member 111 onto the recording material. A fixing unit 103 fixes the toner image transferred onto the recording material on the recording material. A switching member 120 is provided in order to switch between sending the image-formed recording material toward the recording material processing apparatus 200 and discharging the recording material to a discharge tray 124. More specifically, the recording material is discharged to the discharge tray 124 by setting the switching member 120 at the position indicated by the solid line, and the recording material is conveyed to the recording material processing apparatus 200 by setting the switching member 120 at the position indicated by the dotted line. Note that a conveyance path 126 is provided in order to return the recording material once again to the nip region of the photosensitive member 111 and the transfer roller 115 when forming images on both sides of the recording material. Rollers 119 are configured to be rotatable in two directions and convey the recording material to the conveyance path 126 when forming images on both sides of the recording material.

Figure 2:
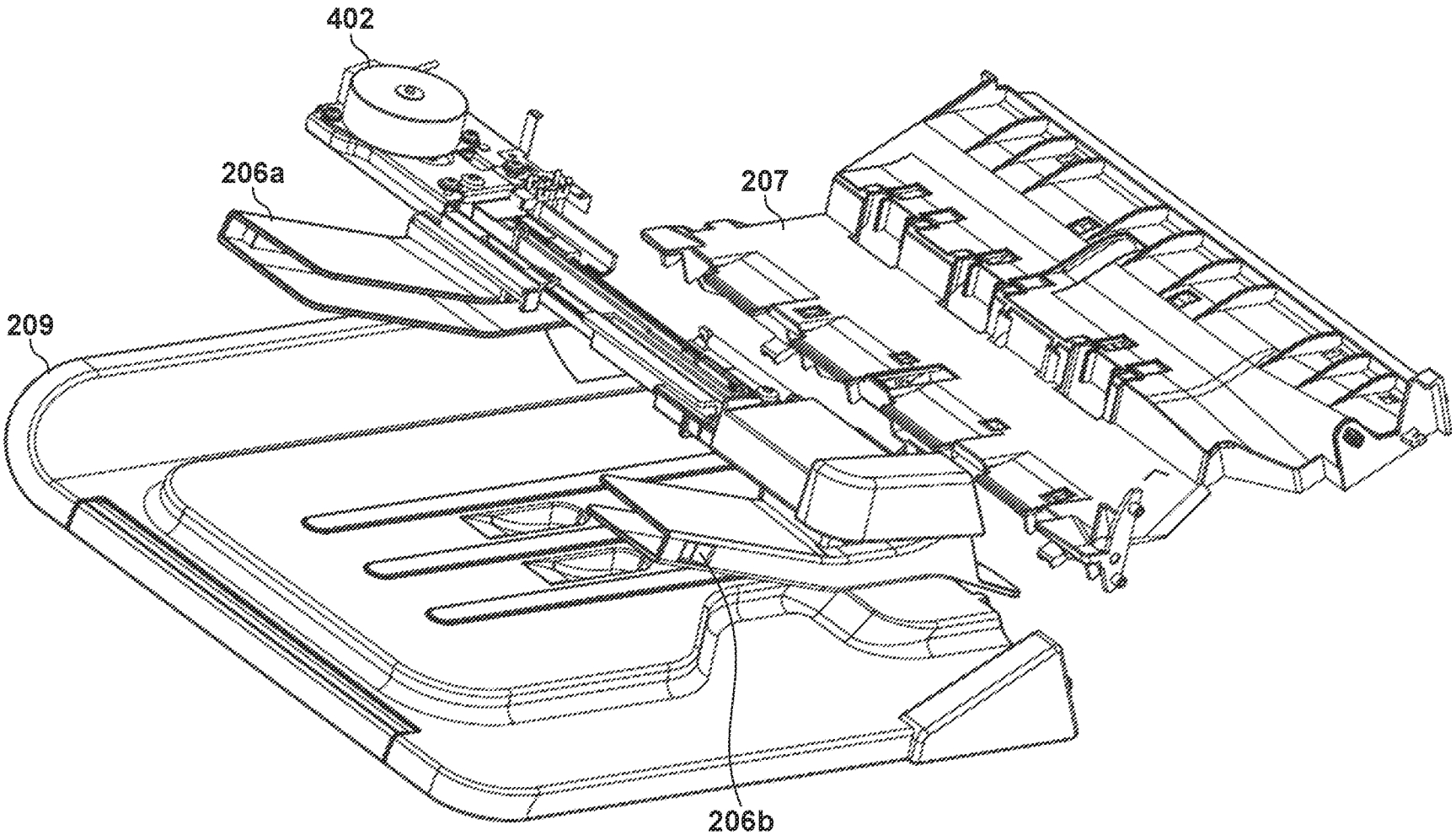
FIG. 2 is a perspective view of a recording material processing apparatus according to an embodiment.

The recording material processing apparatus 200 will be described next with reference to FIGS. 1 and 2. FIG. 2 is a perspective view of the recording material processing apparatus 200. Rollers 201 convey the recording material conveyed to the recording material processing apparatus 200 along a conveyance path 202 toward rollers 203. An intermediate stacking unit 207 (first stacking unit) is provided on the downstream side of the conveyance direction of the rollers 203, and a jogger 206 is provided on the downstream side of the intermediate stacking unit 207. The rollers 203 discharge the recording material to the intermediate stacking unit 207, and the recording material is stacked across the intermediate stacking unit 207 and the jogger 206. Together with supporting both ends of the recording material in the widthwise direction, the jogger 206 aligns the widthwise direction positions of the plurality of stacked recording materials. Note that the widthwise direction is the direction perpendicular to the conveyance direction of the recording material. As shown in FIG. 2, the jogger 206 includes an alignment member 206*a* and an alignment member 206*b*. The alignment members 206*a* and 206*b* are configured to link and move in the widthwise direction by an alignment motor 402. By moving the alignment members 206*a* and 206*b* in the widthwise direction, the widthwise direction positions of the recording materials stacked in the intermediate stacking unit 207 are aligned. An alignment paddle 204 is provided on the upstream side of the jogger 206. The alignment paddle 204 aligns the conveyance direction positions of the recording materials stacked in the intermediate stacking unit 207. A binding unit 208 binds the end portions of the recording materials stacked in the intermediate stacking unit 207. A discharge roller 205 is configured so that it can be either set as a state in contact with the recording materials stacked in the intermediate stacking unit 207 or as a state spaced apart from the recording materials. By placing the jogger 206 in a retracted state not supporting the recording materials and causing the discharge roller 205 to contact the recording materials and rotate, the recording materials are discharged to a stacking unit 209 (second stacking unit) without being stacked in the intermediate stacking unit 207.

When aligning the recording materials, the recording materials are stacked in the intermediate stacking unit 207. At this time, the discharge roller 205 and the recording materials are spaced apart, and the alignment members 206*a* and 206*b* are moved by the alignment motor 402 to a position to receive the recording materials. Accordingly, both ends of the recording materials in the widthwise direction are supported by the jogger 206. Subsequently, by stopping the alignment member 206*b* at an alignment reference position with a mechanical stopper (not shown) and moving the alignment member 206*a*, the recording materials are abutted against the alignment member 206*b* and aligned. In addition, the alignment paddle 204 performs alignment in the conveyance direction. After the recording materials are aligned, a bundle of recording materials is discharged to the stacking unit 209 by causing the discharge roller 205 to contact the recording materials and rotate.

Figure 3:
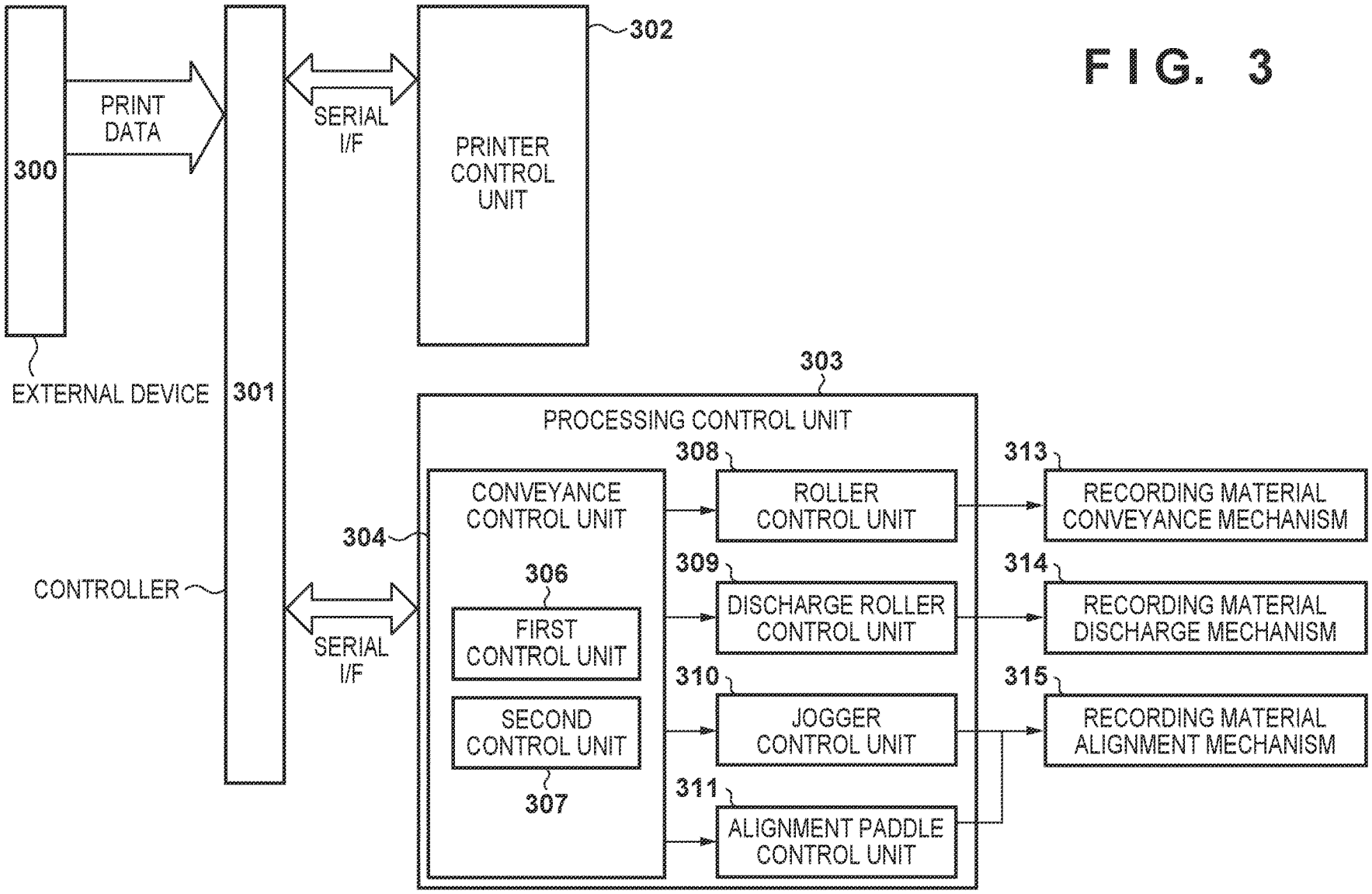
FIG. 3 is a block diagram showing the control arrangement of the image forming apparatus according to an embodiment.

FIG. 3 is a view showing the control arrangement of the image forming apparatus 100. A controller 301 of the image forming apparatus 100 receives print data by communicating with an external device 300 such as a host computer or the like. The controller 301 determines print conditions from the print data and instructs printing in accordance with the print condition to a printer control unit 302 via a serial I/F. The printer control unit 302 controls each mechanism to form and fix an image on the recording material in accordance with the print condition received from the controller 301. Additionally, the controller 301 designates processing conditions to a processing control unit 303 via the serial I/F. Note that the processing control unit 303 is a control unit of the recording material processing apparatus 200. The processing conditions include pieces of information indicating the recording material type, size, number of sheets, presence/absence of offset, and presence/absence of binding processing. A conveyance control unit 304 of the processing control unit 303 performs control of conveying and discharging the recording material in the recording material processing apparatus 200 in accordance with the processing conditions received from the controller 301. More specifically, the conveyance control unit 304 controls a roller control unit 308 which controls a recording material conveyance mechanism 313 including the rollers 201 and rollers 203 to convey the recording material. The conveyance control unit 304 controls a jogger control unit 310 and an alignment paddle control unit 311 to align the recording materials. The jogger control unit 310 drives the alignment motor 402, and the alignment paddle control unit 311 drives the alignment paddle 204. Note that a recording material alignment mechanism 315 of FIG. 3 is a general term for members that align the recording materials and include the jogger 206 and the alignment paddle 204 and is also referred to as an alignment unit. Additionally, under the control of the conveyance control unit 304, a discharge control unit 309 controls a recording material discharge mechanism 314 including the discharge roller 205 to discharge the recording material to the stacking unit 209. Note that a first control unit 306 and a second control unit 307 of the conveyance control unit 304 will be described later.

Figure 4:
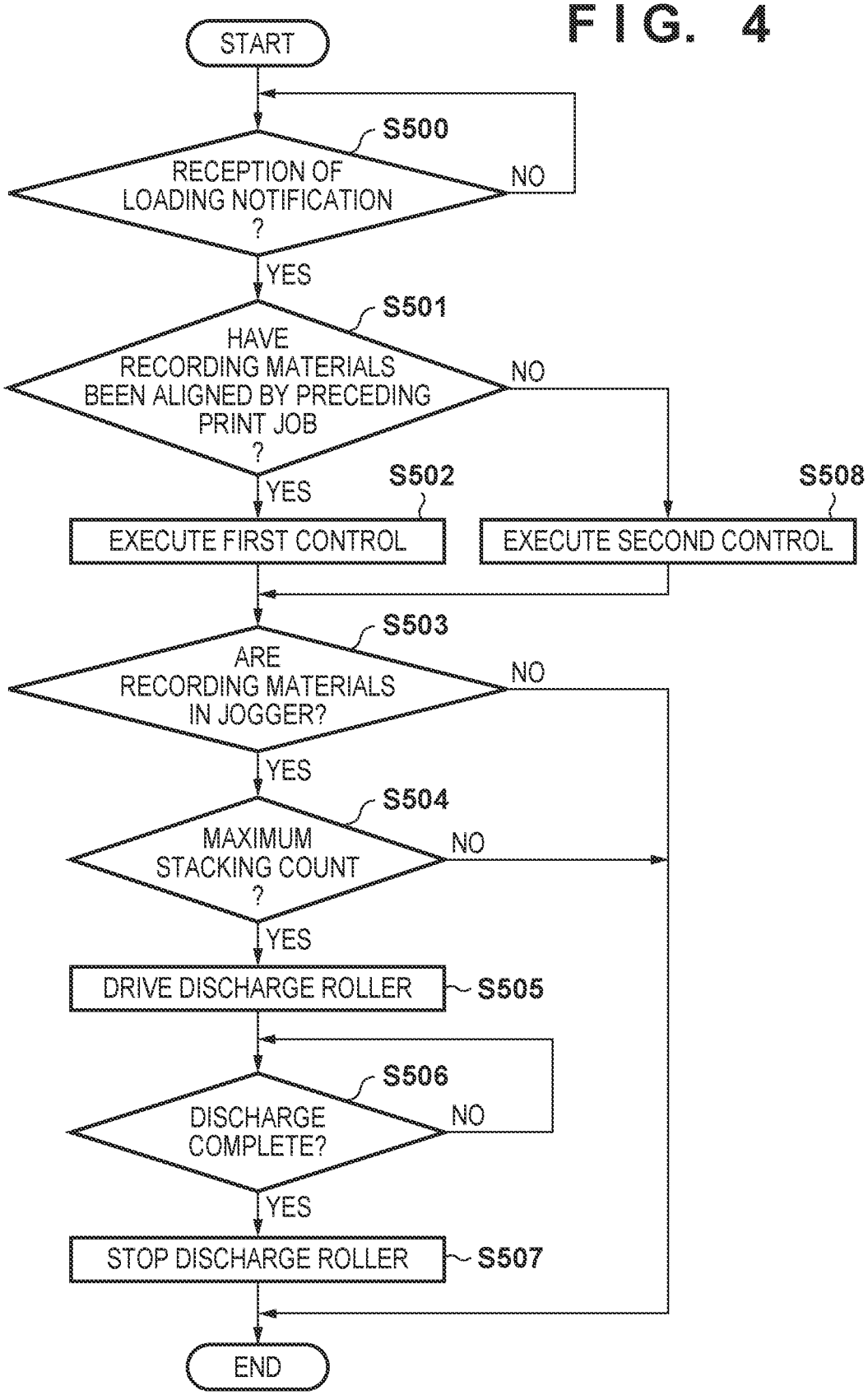
FIG. 4 is a flowchart showing discharge control according to an embodiment.

FIG. 4 is a flowchart showing the processing of the conveyance control unit 304 when the offset is performed for each print job. In step S500, the conveyance control unit 304 stands by until it receives a loading notification from the controller 301. In step S501, upon receiving the loading notification from the controller 301, the conveyance control unit 304 determines whether recording material alignment was performed in the preceding print job. If alignment was performed in the preceding print job, the first control unit 306 performs the first control in step S502. On the other hand, if no alignment was performed in the preceding print job, the second control unit 307 performs the second control in step S508. The first control and the second control will be described later. In step S503, the conveyance control unit 304 monitors whether there are recording materials on the jogger 206 and ends the processing if no recording materials exist. On the other hand, if recording materials exist, in step S504, the conveyance control unit 304 determines whether the recording materials on the jogger 206 have reached the maximum stacking count as a threshold and ends the processing if the maximum stacking count has not been reached. On the other hand, if the maximum stacking count has been reached, in step S505, the conveyance control unit 304 drives the discharge roller 205 and discharges the recording materials to the stacking unit 209. In step S506, the conveyance control unit 304 stands by until discharging of the recording materials is completed. When the discharging is completed, the conveyance control unit 304 stops the driving of the discharge roller 205 in step S507.

Figure 5:
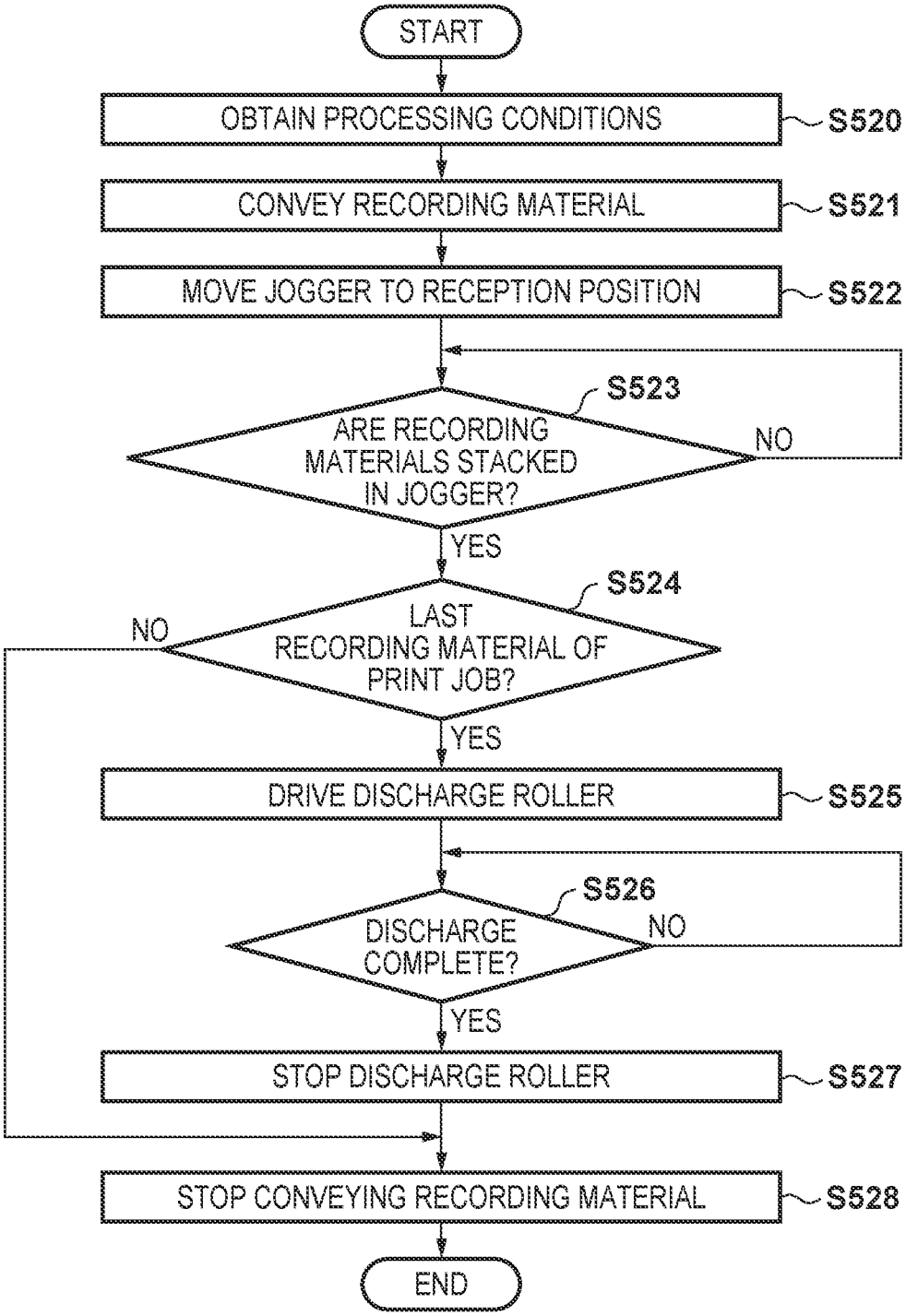
FIG. 5 is a flowchart showing first discharge control according to an embodiment.
Figure 6:
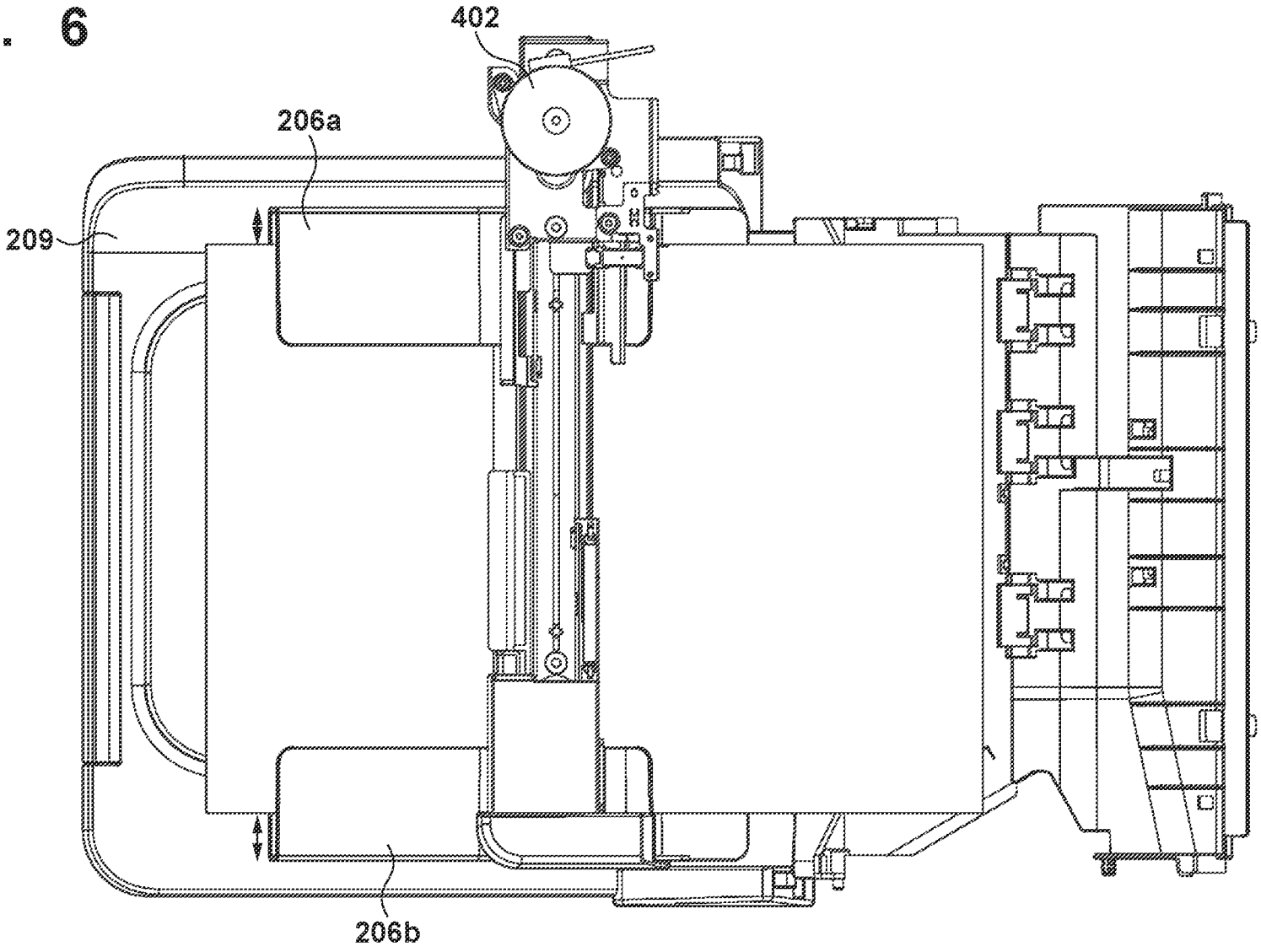
FIG. 6 is a view showing a state in which recording materials are stacked in an intermediate stacking unit in the first discharge control according to an embodiment.

FIG. 5 is a flowchart of the first control operation. The first control represents control of discharging recording materials to the stacking unit 209 without alignment. The first control unit 306 obtains the processing conditions in step S520 and drives the rollers 201 and 203 to convey each recording material toward the intermediate stacking unit 207 in step S521. Additionally, in step S522, the first control unit 306 moves the jogger 206 to the reception position. In step S523, the first control unit 306 stands by until a recording material is stacked on the jogger 206. When the recording material is stacked, the first control unit 306 determines whether the stacked recording material is the last recording material of the print job. If it is not the last recording material, the first control unit 306 stops the driving of the rollers 201 and 203 and ends the processing in step S528. FIG. 6 shows the state at that time, that is, the state when the jogger 206 is stopped at the reception position and unaligned recording materials are stacked in the intermediate stacking unit 207. On the other hand, if it is determined to be the last recording material of the print job in step S524, the first control unit 306 drives the discharge roller 205 to discharge the recording materials to the stacking unit 209 in step S525 and stands by until discharging is completed in step S526. When the discharging is completed, the first control unit 306 stops the discharge roller 205 in step S527 and performs the process of step S528.

Figure 7:
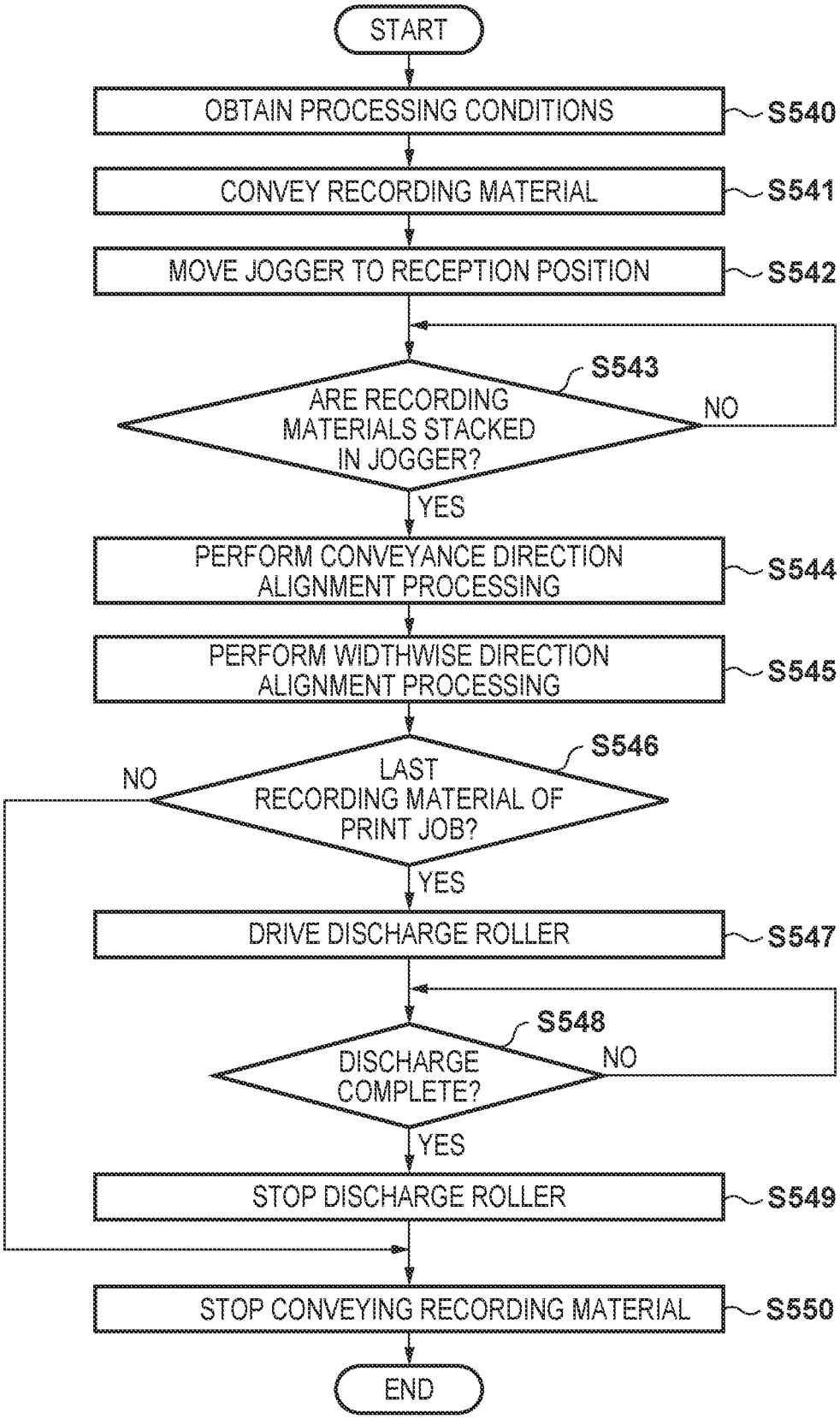
FIG. 7 is a flowchart showing second discharge control according to an embodiment.
Figure 8:
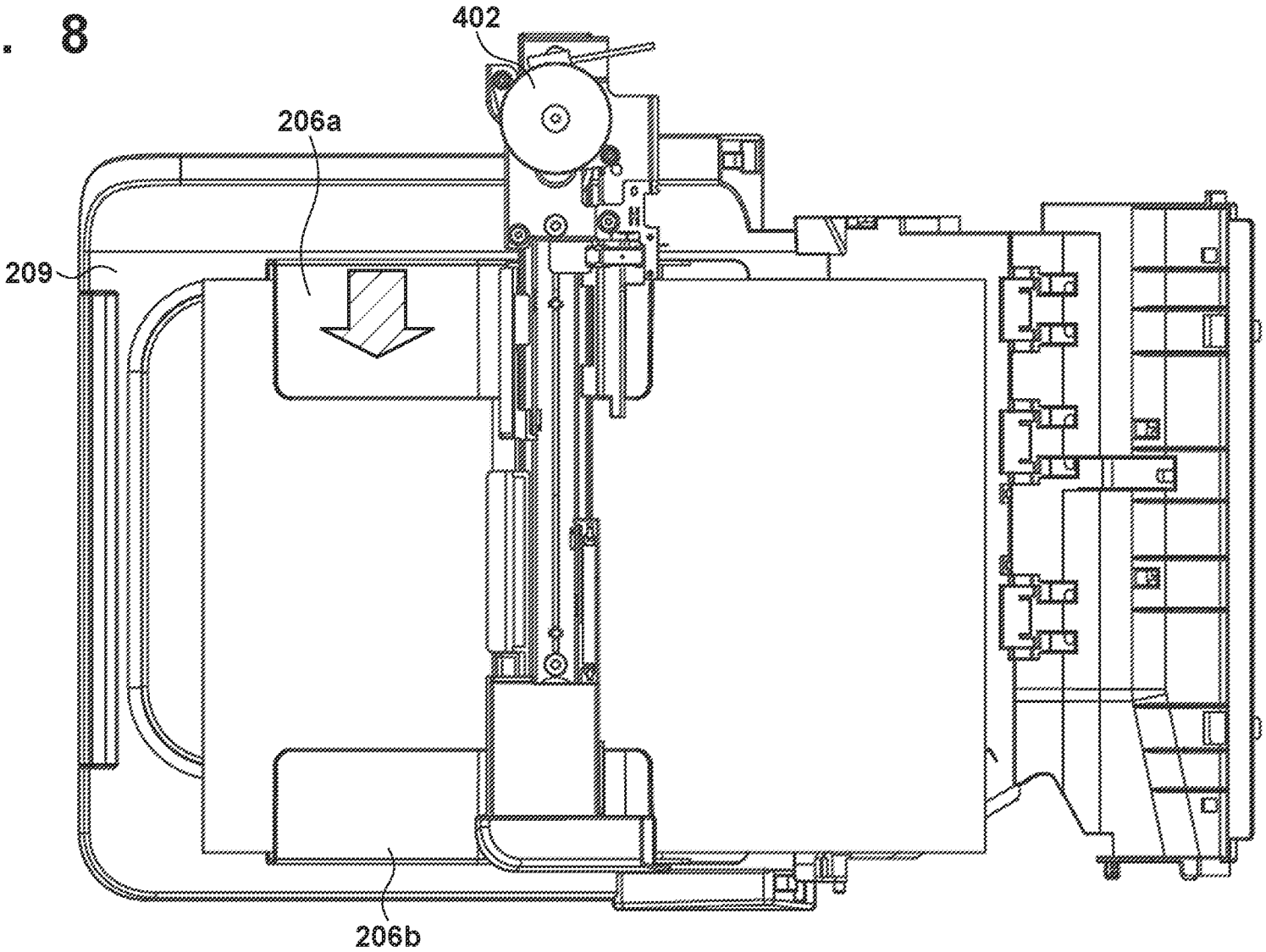
FIG. 8 is a view showing a state in which recording materials are stacked in the intermediate stacking unit in the second discharge control according to an embodiment.

FIG. 7 is a flowchart of the second control operation by the second control unit 307. The second control represents control of aligning the recording materials stacked in the intermediate stacking unit 207 by the jogger 206 and discharging the recording materials stacked in the intermediate stacking unit 207 to the stacking unit 209 upon completion of the print job. Since the processes of steps S540 to S543 are the same as steps S520 to S523 of the first control in FIG. 5, a repetitive description thereof will be omitted. When the recording materials are stacked in the jogger 206 in step S543, the second control unit 307 performs conveyance direction alignment processing by the alignment paddle 204 in step S544 and performs widthwise direction alignment processing by the jogger 206 in step S545. FIG. 8 shows how the aligned recording materials are stacked in the intermediate stacking unit 207. Since the processes of steps S546 to S550 are the same as steps S524 to S528 of the first discharge control in FIG. 5, a repetitive description thereof will be omitted.

The processing in which alignment is performed by abutting the recording material against the alignment member 206*b* by the alignment member 206*a* is not performed in the first control. Accordingly, each recording material discharged to the stacking unit 209 in the first control is offset with respect to each recording material discharged to the stacking unit 209 in the second control. In this embodiment, the first control and the second control are alternately executed for a unit of processing of the recording materials. Therefore, the recording materials discharged to the stacking unit 209 are offset for the unit of processing. Note that the unit of processing corresponds to the print job designated by a user, and the controller 301 notifies the recording material processing apparatus 200 of each process as a processing condition. Note that in the second control of FIG. 7, the alignment of recording materials is performed each time a recording material that is a target of the second control is stacked in the intermediate stacking unit 207. In the second control, however, the timing for aligning the recording materials by the jogger 206 or the like is not limited to this. For example, it can be an arrangement in which the plurality of recording materials are stacked in the intermediate stacking unit 207 or an arrangement in which the last recording material of a print job is stacked in the intermediate stacking unit 207.

Figure 9:
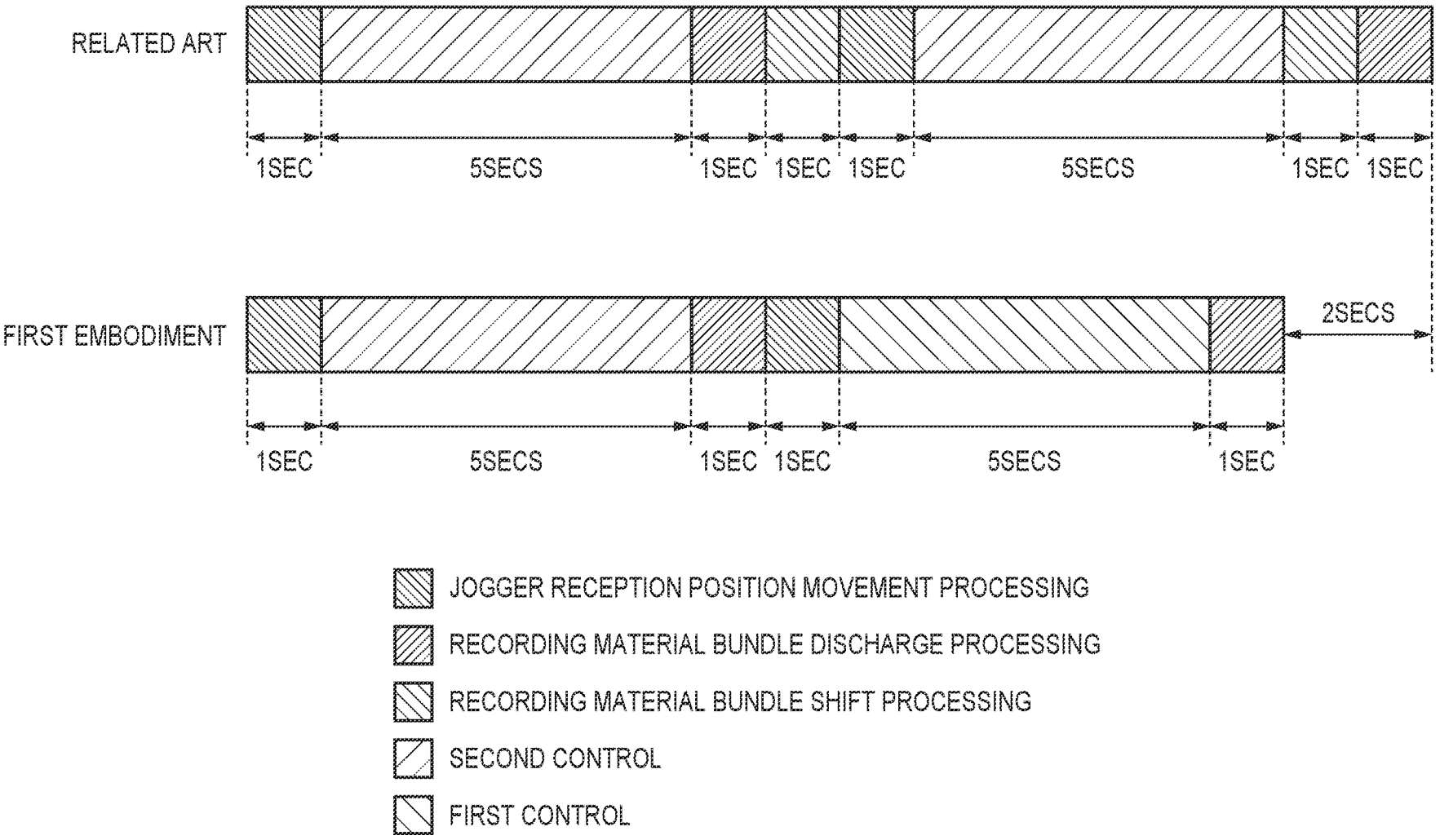
FIG. 9 is an explanatory view for comparing the throughputs of an embodiment and a related art.

FIG. 9 is a view for comparing the throughput of the offset control of the related art with the throughput of the offset control according to the embodiment. Comparison is made for a case in which two sets of a five-sheet print job have been performed. For example, assume that processing of moving the jogger 206 to the reception position, recording material bundle discharge processing, and bundle shift processing each take 1 sec, and that the first control for the five sheets of recording materials and the second control each take 5 sec. Note that the first control and the second control in this example exclude the processing of moving the jogger 206 to the reception position and the recording material discharge processing. In this case, since the embodiment does not require the bundle shift processing, the processing is completed 2 sec earlier than the related art. Note that the related art constantly performs alignment and both two sets correspond to the second control.

As described above, a plurality of alignment motors need not be provided in the embodiment. Furthermore, since no bundle shift operation is performed, an interval between recording materials which is necessary for performing bundle shift need not be provided, and the throughput of offset control can be improved.

Second Embodiment

Differences from the first embodiment will be mainly explained in the second embodiment. In the first control of the first embodiment, even recording materials that did not need alignment were temporarily stacked in the intermediate stacking unit 207 and discharged as a bundle to the stacking unit 209 after the last recording material of the print job was stacked in the intermediate stacking unit 207. Therefore, the control for moving the jogger 206 to the reception position and discharging the recording materials as a bundle is necessary. In the first control of this embodiment, a recording material is directly discharged to a stacking unit 209 without being stacked in an intermediate stacking unit 207.

Figure 10:
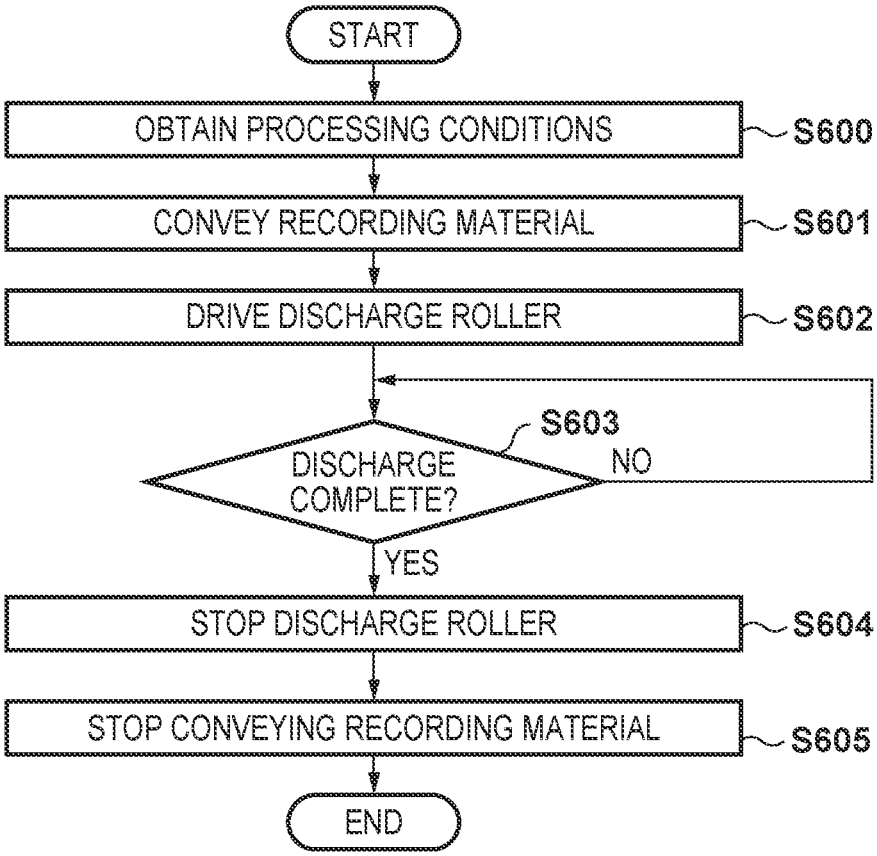
FIG. 10 is a flowchart showing first discharge control according to an embodiment.

FIG. 10 is a flowchart showing the first control according to the embodiment. A first control unit 306 obtains processing conditions in step S600 and conveys each recording material toward the intermediate stacking unit 207 in step S601. In step S602, the first control unit 306 drives a discharge roller 205 to discharge the recording materials to the stacking unit 209 and stands by until discharging is completed in step S603. When the discharging is completed, the first control unit 306 stops the discharge roller 205 in step S604, stops the driving of rollers 201 and 203 in step S605, and ends the processing. Note that the processing of FIG. 10 is repeated during one print job.

Figure 11:
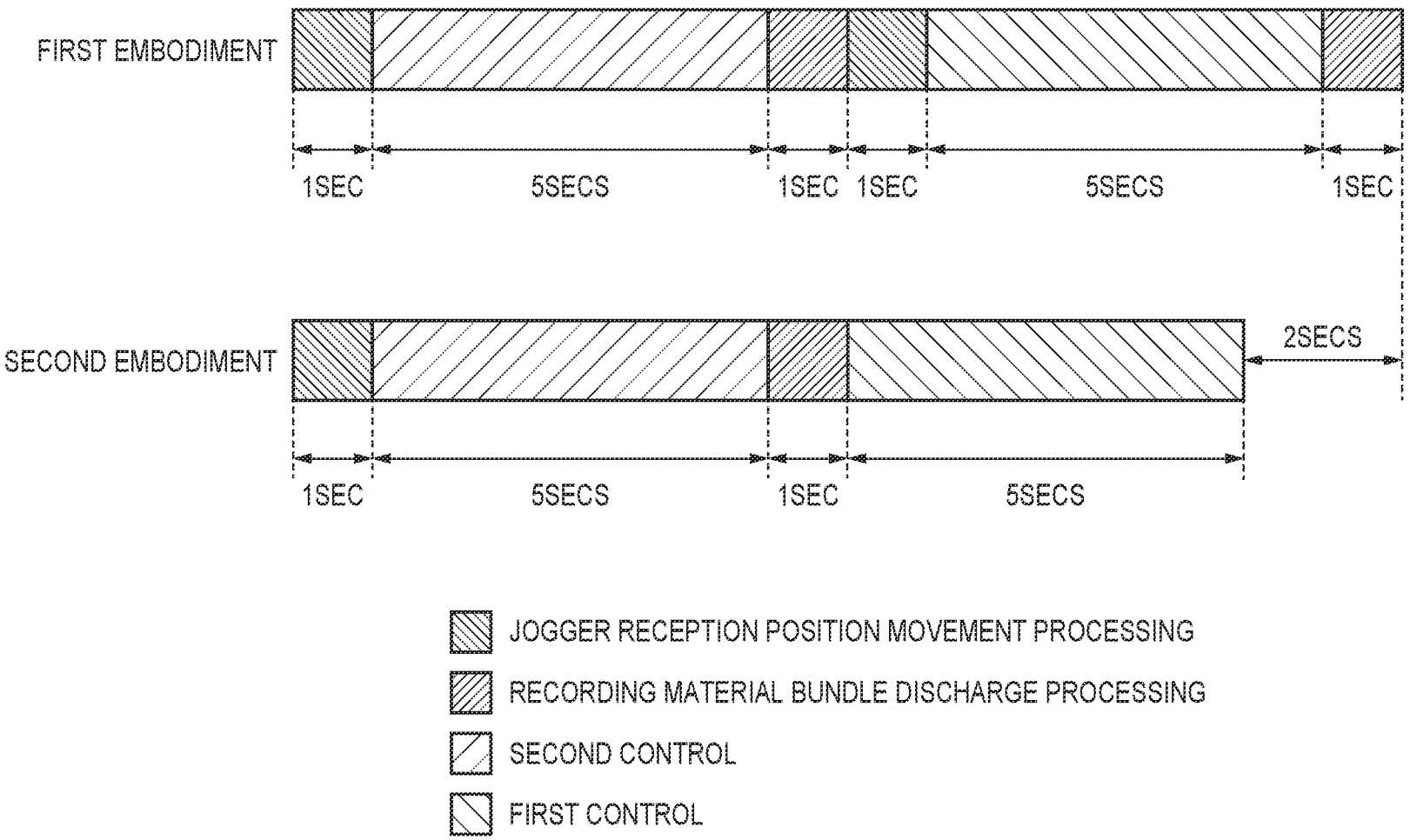
FIG. 11 is an explanatory view for comparing the throughputs of embodiments.

FIG. 11 is a view for comparing the throughputs of the second embodiment and first embodiment. Note that FIG. 11 shows a case in which two sets of a five-sheet print job have been processed. For example, assume that processing for moving a jogger 206 to a reception position and recording material bundle discharge processing each take 1 sec, and that the first control for the five sheets of recording materials and the second control each take 5 sec. Note that the first control and the second control in this example exclude the processing of moving the jogger 206 to the reception position and the recording material discharge processing. In the first control of this embodiment, the processing is completed 2 sec earlier than that of the first embodiment since the movement of the jogger 206 and the recording material discharge processing as in the first embodiment are not necessary.

As described above, the throughput of offset control can be improved by directly discharging the recording materials to the stacking unit 209 without stacking the recording materials in the intermediate stacking unit 207 in the first control.

Third Embodiment

Next, differences from the second embodiment will be mainly explained in the third embodiment. In the first control of the second embodiment, since the recording materials are stacked in the stacking unit 209 without being stacked in the intermediate stacking unit 207, there is a possibility that stackability will be lower than the first embodiment in which the recording materials are discharged as a bundle. The third embodiment improves both the stackability and throughput.

The second control of the second embodiment stacked and aligned recording materials in the intermediate stacking unit 207 and discharged a bundle of recording materials to the stacking unit 209. In the second control of the third embodiment, when the first control is performed after the second control, recording materials are not discharged to a stacking unit 209. Recording materials as a target of the succeeding first control are stacked over the recording materials aligned in the preceding second control in an intermediate stacking unit 207 and discharged all together to the stacking unit 209 at the end of the first control.

Figure 12:
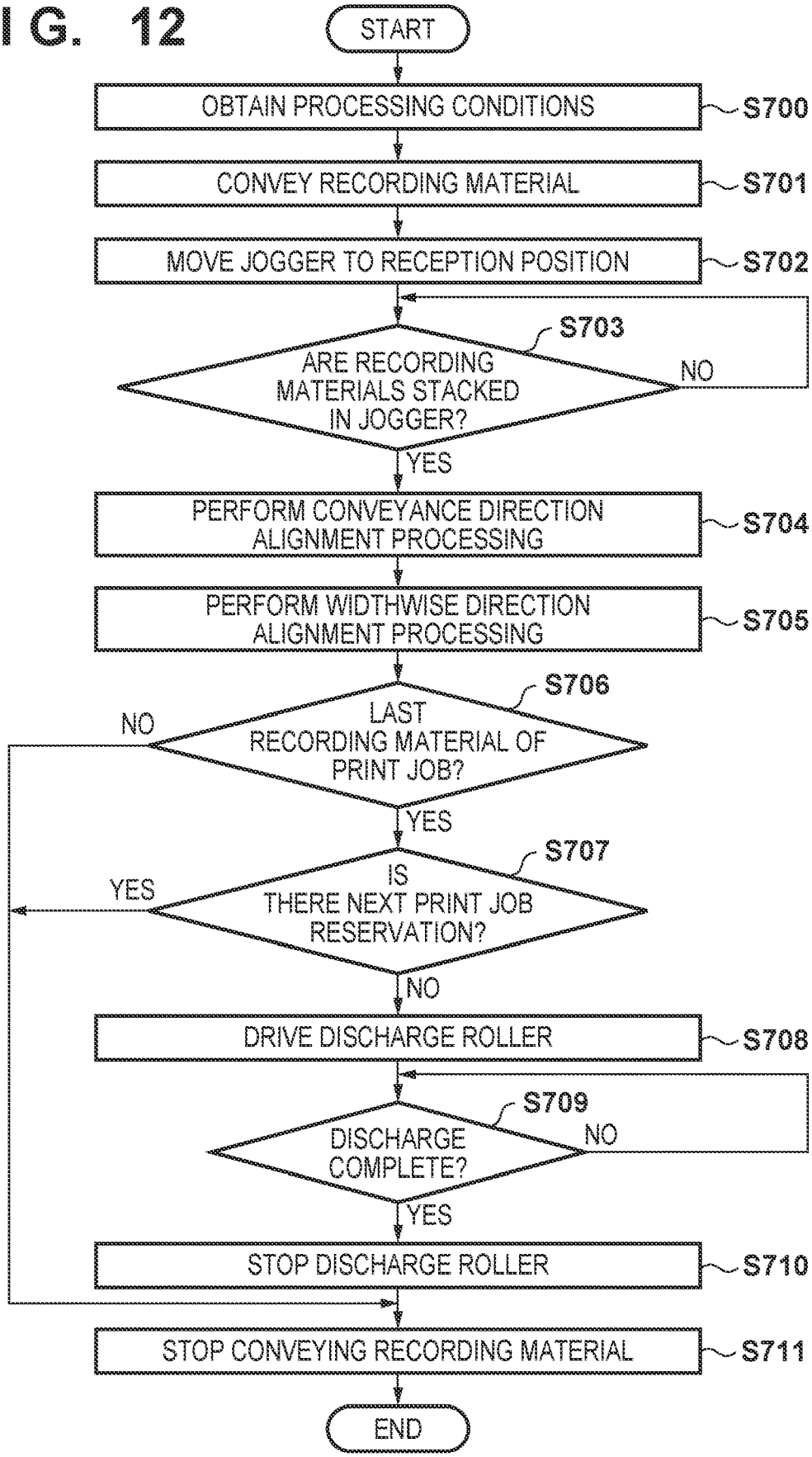
FIG. 12 is a flowchart showing second discharge control according to an embodiment.
Figure 13:
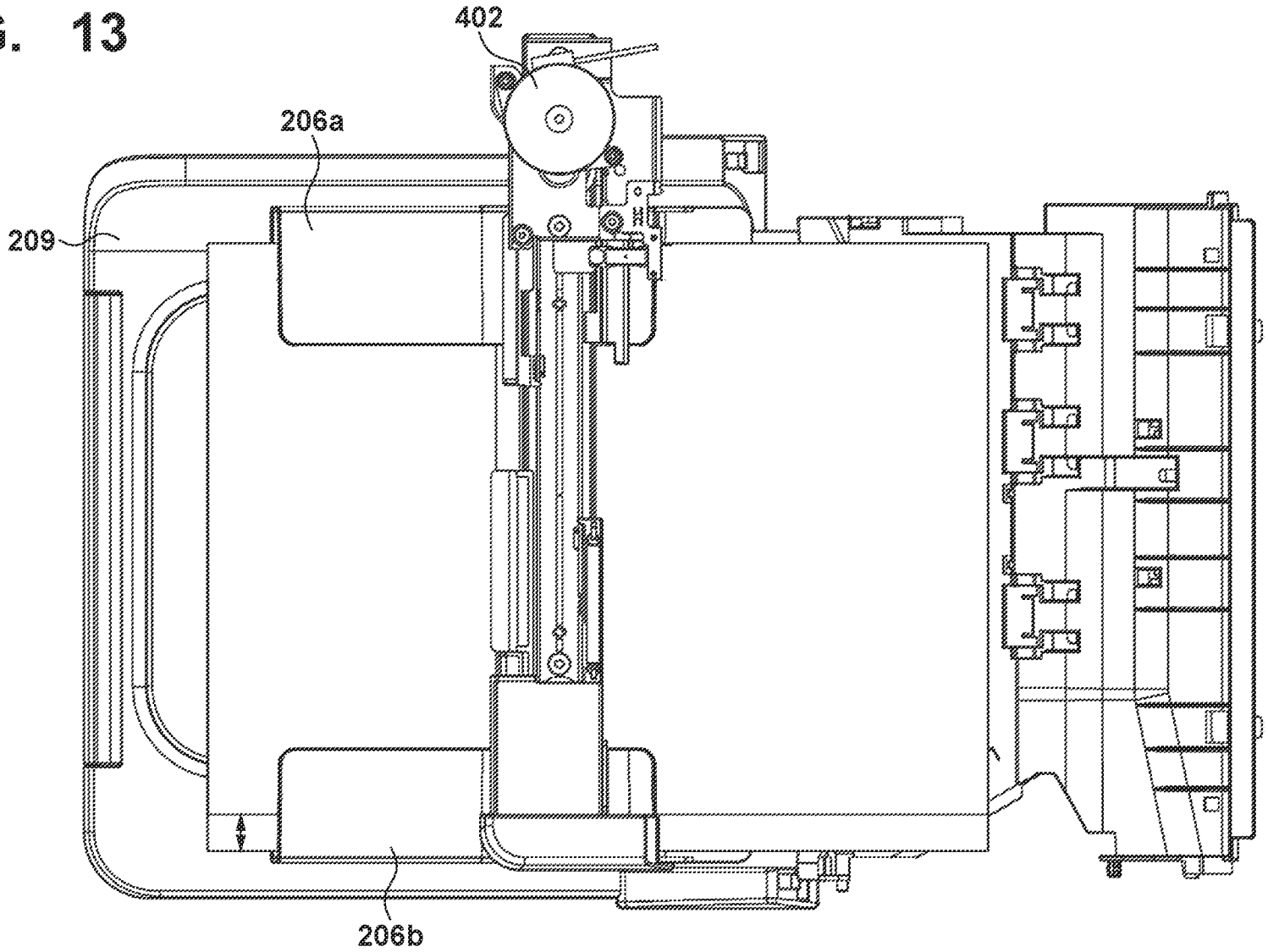
FIG. 13 is a view showing a state in which recording materials are stacked in an intermediate stacking unit in discharge control according to an embodiment.

FIG. 12 is a flowchart showing the discharge control according to the embodiment. Processes of steps S700 to S706 and step S711 are the same as the processes of steps S540 to S546 and step S550 of the second discharge control shown in FIG. 7, and a repetitive description thereof will be omitted. When a recording material is determined to be the last recording material of a print job in step S706, a second control unit 307 confirms whether there is a next print job reservation in step S707. If the next print job reservation exists, the second control unit 307 performs the process of step S711 and ends the process without discharging the recording materials to the stacking unit 209. If no next print job exists, the same processes as in steps S547 to S549 of FIG. 7 are performed and the recording materials are discharged to the stacking unit 209 in steps S708 to S710. FIG. 13 shows how the recording materials as a target of the first control are stacked over the aligned recording materials in the first control which is performed after the second control.

Figure 14:
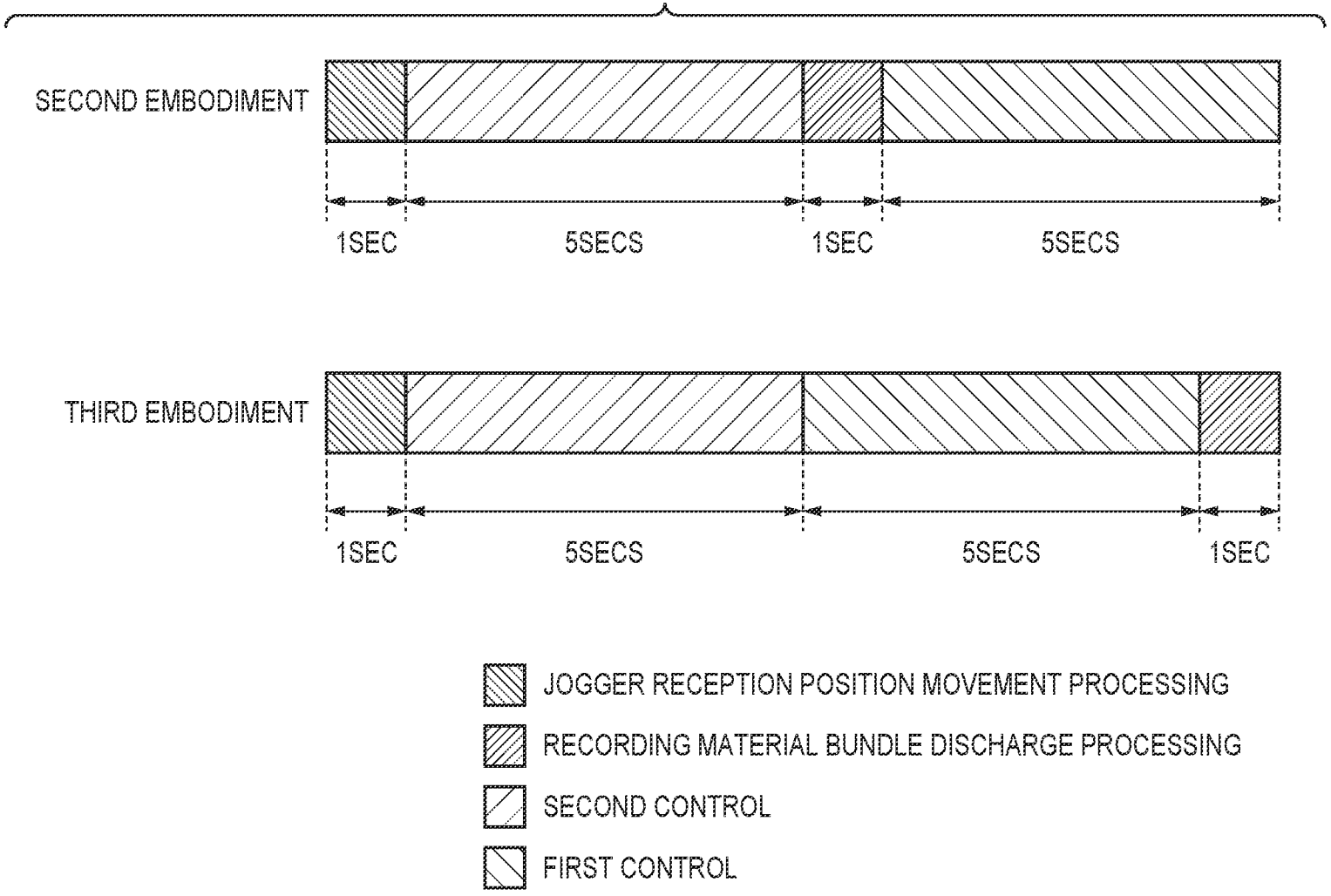
FIG. 14 is an explanatory view for comparing the throughputs of embodiments.

FIG. 14 is a view comparing the throughput of the second embodiment with the throughput of the third embodiment. Note that FIG. 14 shows a case in which two sets of a five-sheet print job have been processed. For example, assume that processing for moving a jogger 206 to a reception position and recording material bundle discharge processing each take 1 sec, and that the first control for the five sheets of recording materials and the second control each take 5 sec. Note that the first control and the second control in this example exclude the processing of moving the jogger 206 to the reception position and the recording material discharge processing. Comparing this embodiment with the second embodiment, the throughput is the same as the second embodiment since only the discharge processing timings of the recording material bundles are different. Therefore, the throughput becomes 2 sec earlier than the first embodiment. Note that since the recording materials are also temporarily stacked in the intermediate stacking unit 207 in the first control, the stackability is the same as the first embodiment in this embodiment.

As described above, when there is a print job after the second control, the recording materials are not discharged in the second control but discharged all together in the succeeding first control. This arrangement allows both high stackability and high throughput.

OTHER EMBODIMENTS

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-261248, filed on Dec. 24, 2014, which is hereby incorporated by reference herein in its entirety.

What is claimed is:

1. A recording material processing apparatus comprising:

a conveyance unit configured to convey a recording material;

an intermediate stacking unit on which a recording material conveyed by the conveyance unit is stacked;

an alignment unit including a first alignment member and a second alignment member, the first alignment member and the second alignment member being configured to support the recording material stacked on the intermediate stacking unit, wherein at least the first alignment member approaches the second alignment member to align the recording material stacked on the intermediate stacking unit in a direction perpendicular to a conveyance direction of the recording material;

a stacking unit on which the recording material is stacked, wherein the recording material stacked on the intermediate stacking unit is discharged to the stacking unit when at least the first alignment member separates from the second alignment member; and a control unit configured to, when performing a series of print jobs including a first print job, a second print job, and a third print job in the order of the first print job, the second print job, and the third print job, execute one of a first control and a second control for the first print job and the third print job, and execute the other of the first control and the second control for the second print job, wherein, in a case where the control unit executes the first control, the control unit controls the alignment unit to not support a first recording material stacked on the intermediate stacking unit, wherein, in a case where the control unit executes the second control, the control unit controls the alignment unit to support a second recording material stacked on the intermediate stacking unit, to align the second recording material in the direction perpendicular to the conveyance direction, and wherein, in a case where the control unit executes the first control subsequent to the second control, the control unit (1) does not discharge the second recording material stacked on the intermediate stacking unit to the stacking unit in the second control, (2) stacks the first recording material over the second recording material stacked on the intermediate stacking unit in the first control subsequent to the second control, and (3) discharges the second recording material and the first recording material to the stacking unit in the first control subsequent to the second control.

2. The recording material processing apparatus according to claim 1, wherein the first alignment member is further configured to support one end of the recording material in the direction perpendicular to the conveyance direction, and wherein the second alignment member is further configured to support the other end of the recording material in the direction perpendicular to the conveyance direction.

3. The recording material processing apparatus according to claim 1, further comprising a discharging roller configured to be set in one of (a) a first state, in which the discharging roller is in contact with the recording material stacked on the intermediate stacking unit, and (b) a second state, in which the discharging roller is not in contact with the recording material stacked on the intermediate stacking unit, wherein the recording material stacked on the intermediate stacking unit is discharged to the stacking unit when the first alignment member separates from the second alignment member and the discharging roller is set to the first state and rotates.

4. The recording material processing apparatus according to claim 1, wherein the first alignment member approaches the second alignment member in a state where the second alignment member stops at a reference position to align the recording material stacked on the intermediate stacking unit in the direction perpendicular to the conveyance direction.

* * * * *